US006019488A

United States Patent [19]

Hastings

[11] Patent Number: 6,019,488

[45] Date of Patent: Feb. 1, 2000

[54] LIGHT STRING MOUNTING SYSTEM

[76] Inventor: Herman Hastings, 1731 Valle Moor Dr., Bismarck, N. Dak. 58501-2579

[21] Appl. No.: 09/071,132

[22] Filed: Apr. 30, 1998

[51] Int. Cl.[7] ..... F21V 21/00

[52] U.S. Cl. ..... 362/374; 362/152; 362/240

[58] Field of Search ..... 362/374, 375, 362/152, 240

[56] References Cited

U.S. PATENT DOCUMENTS

| | | | |
|---|---|---|---|
| 5,311,414 | 5/1994 | Branham, Sr. | 362/249 X |
| 5,410,458 | 4/1995 | Bell | 362/240 X |
| 5,510,966 | 4/1996 | Konecny | 362/240 X |
| 5,594,628 | 1/1997 | Reuther et al. | 362/374 X |
| 5,816,687 | 10/1998 | Tapp | 362/374 X |

*Primary Examiner*—Laura K. Tso

*Attorney, Agent, or Firm*—Michael S. Neustel

[57] ABSTRACT

A light string mounting system which provides simple alignment with respect to rain gutters which provides sufficient space for the cover to remain in the open position. The inventive device includes an elongated base having a U-shaped cross-section, a cover pivotally attached to an upper portion of the base, a bias spring between the cover and the base, and at least one guide member for maintaining a constant distance between the invention and a rain gutter. The bias spring retains the cover in the closed position when the light string is not in use. When the cover is opened to expose the light string, the bias spring retains the cover in the open position. The cover and the base are coated with material which matches the color of the trim of the building structure. The bias spring has a tapered U-shape which prevents side movement of the bias spring during opening and closing of the cover.

18 Claims, 4 Drawing Sheets

LIGHT STRING MOUNTING SYSTEM

BACKGROUND OF THE INVENTION

1. Field of the Invention

The present invention relates generally to light string housing devices and more specifically it relates to a light string mounting system which provides simple alignment with respect to rain gutters thereby providing sufficient space for the cover to remain in the open position.

Light string housing devices are commonly installed around the roof edge of a building structure, most commonly for housing Christmas decorations. Strings of lights having weatherproof bulbs are mounted within the light string housing devices. Some light string housing devices have covers which are pivotally attached to a channeled base. If the light string housing device is installed to close to a rain gutter or similar obstruction, the cover will not open completely thereby increasing the chance that the cover will accidentally close. It is thereby desirable to provide an assembly thereby providing simple alignment with respect to rain gutters which provides sufficient space for the cover to remain in the open position.

2. Description of the Prior Art

There are numerous light string housing devices. For example, U.S. Pat. No. 5,510,966 to Konecny; U.S. Pat. No. 5,311,414 to Branham; U.S. Pat. No. 5,404,279 to Wood; U.S. Pat. No. 5,594,628 to Reuter et al; U.S. Pat. No. 5,707,136 to Byers; U.S. Pat. No. 5,260,859 to Lettenmayer; U.S. Pat. No. 4,521,838 to Agabekov; U.S. Pat. No. 5,161,882 to Garrett; and U.S. Pat. No. 2,648,152 to Simpson are all illustrative of such prior art.

Konecny (U.S. Pat. No. 5,510,966) discloses a fixture for mounting to a structure which protectively encloses at least one string of lights when the lights are not in use. The fixture comprises an elongated housing with an open side, a cover movably and pivotally attached to the housing for selectively enclosing the open side.

Branham (U.S. Pat. No. 5,311,414) discloses a Christmas light mounting apparatus. Branham teaches an elongate housing having a base plate, a cover plate and a V-shaped plate pivotally attached to the cover plate for providing selective viewing of Christmas tree lights.

While these devices may be suitable for the particular purpose to which they address, they do not provide a means for simple alignment with respect to rain gutters which provides sufficient space for the cover to remain in the open position.

In these respects, the light string mounting system according to the present invention substantially departs from the conventional concepts and designs of the prior art, and in so doing provides an apparatus primarily developed which provides simple alignment with respect to rain gutters which provides sufficient space for the cover to remain in the open position.

SUMMARY OF THE INVENTION

A primary object of the present invention is to provide a light string mounting system that will overcome the shortcomings of the prior art devices.

Another object is to provide a light string mounting system that is an inexpensive permanent seasonal lighting system which follows a trim line.

An additional object is to provide a light string mounting system that is provided in various colors which match the trim of a house.

A further object is to provide a light string mounting system that insures that there will be sufficient space above the invention for allowing complete opening of the cover.

Another object is to provide a light string mounting system that retains at least one string of lights.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWINGS

Various other objects, features and attendant advantages of the present invention will become fully appreciated as the same becomes better understood when considered in conjunction with the accompanying drawings, in which like reference characters designate the same or similar parts throughout the several views, and wherein.

DESCRIPTION OF THE PREFERRED EMBODIMENT

Figure 1:
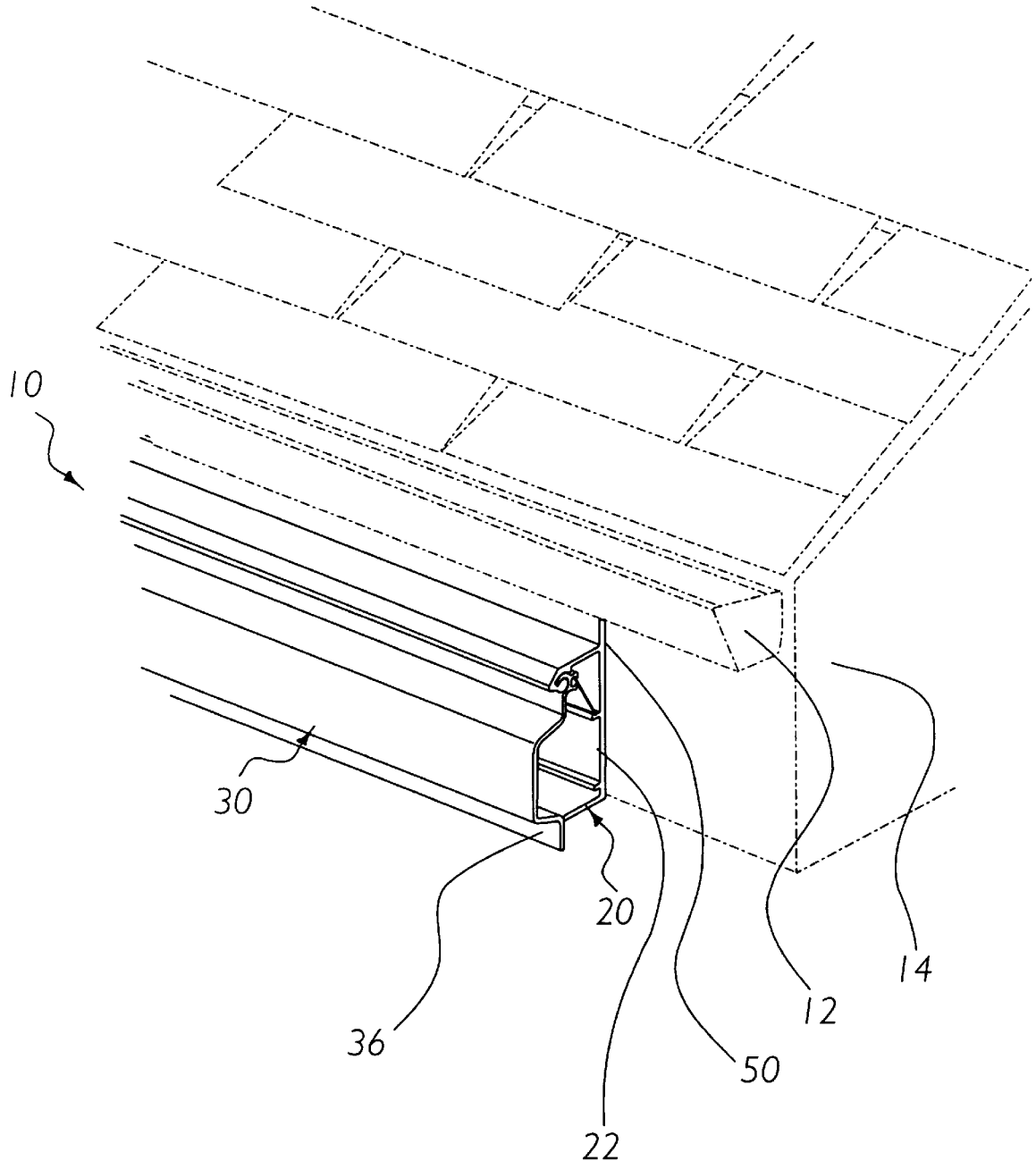
FIG. 1 is an upper perspective view of the present invention attached to the trim of a building structure.

Turning now descriptively to the drawings, in which similar reference characters denote similar elements throughout the several view, FIGS. 1 through 4 illustrate a light string mounting system 10, which comprises an elongated base 20 having a U-shaped cross-section, a cover 30 pivotally attached to an upper portion of the elongated base 20, a bias spring 40 between the cover 30 and the elongated base 20, and a guide member 50 attached to an upper portion of the elongated base 20. The bias spring 40 retains the cover 30 in the closed position when the light string is not in use. When the cover 30 is opened to expose the tubular light string 18, the bias spring 40 retains the cover 30 in the open position. The exterior portion of the cover 30 and the elongated base 20 are coated with material which matches the color of the trim 14 of the building structure.

As best shown in FIG. 1 of the drawings, the elongated base 20 is attached to the trim 14 of the house by conventional fasteners such as screws, nails or bolts. The elongated base 20 is generally positioned directly beneath the rain gutter 12 or where conventional Christmas lights are generally mounted.

Figure 2:
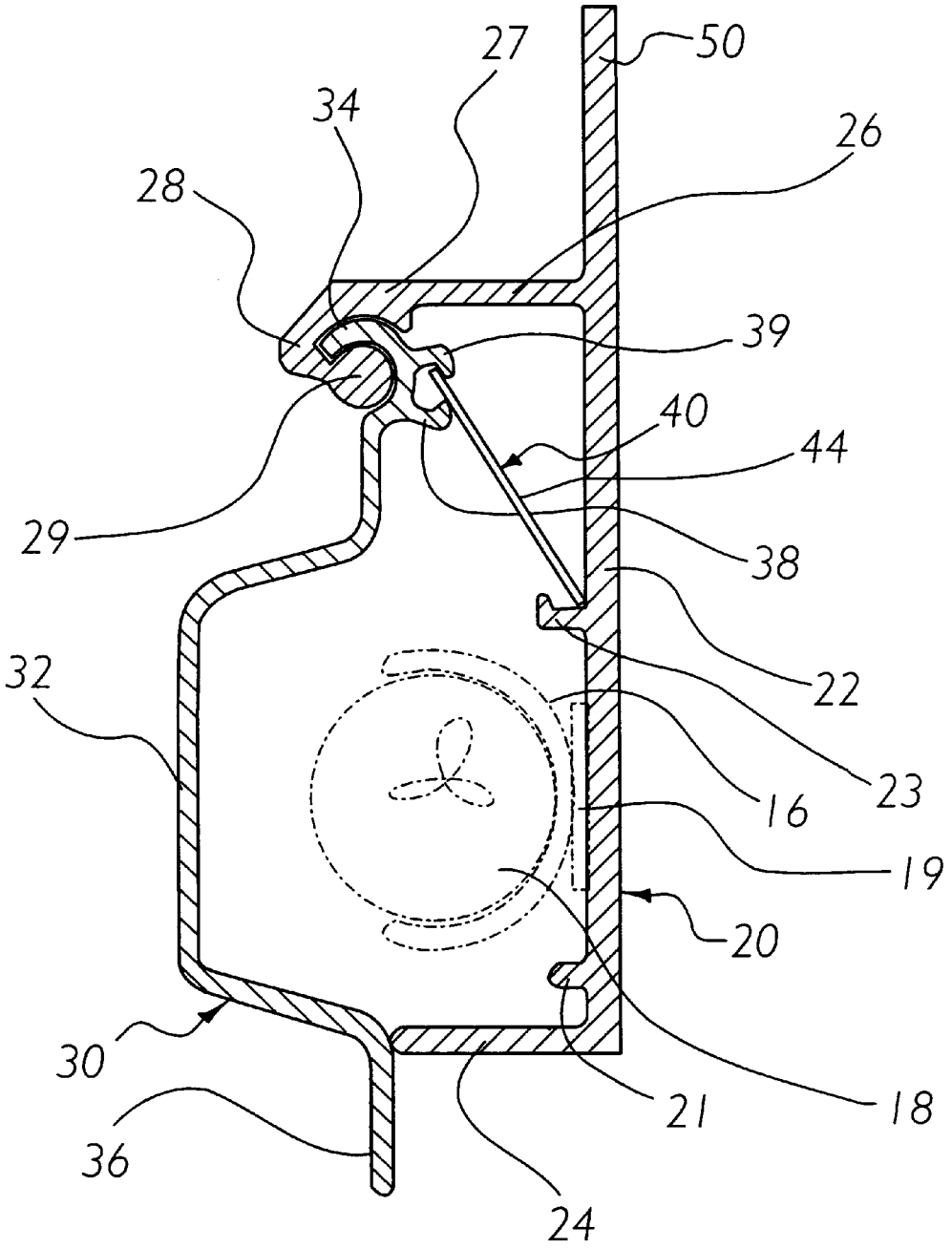
FIG. 2 is a cross sectional view along line 2—2 of FIG. 1 with the cover closed.
Figure 3:
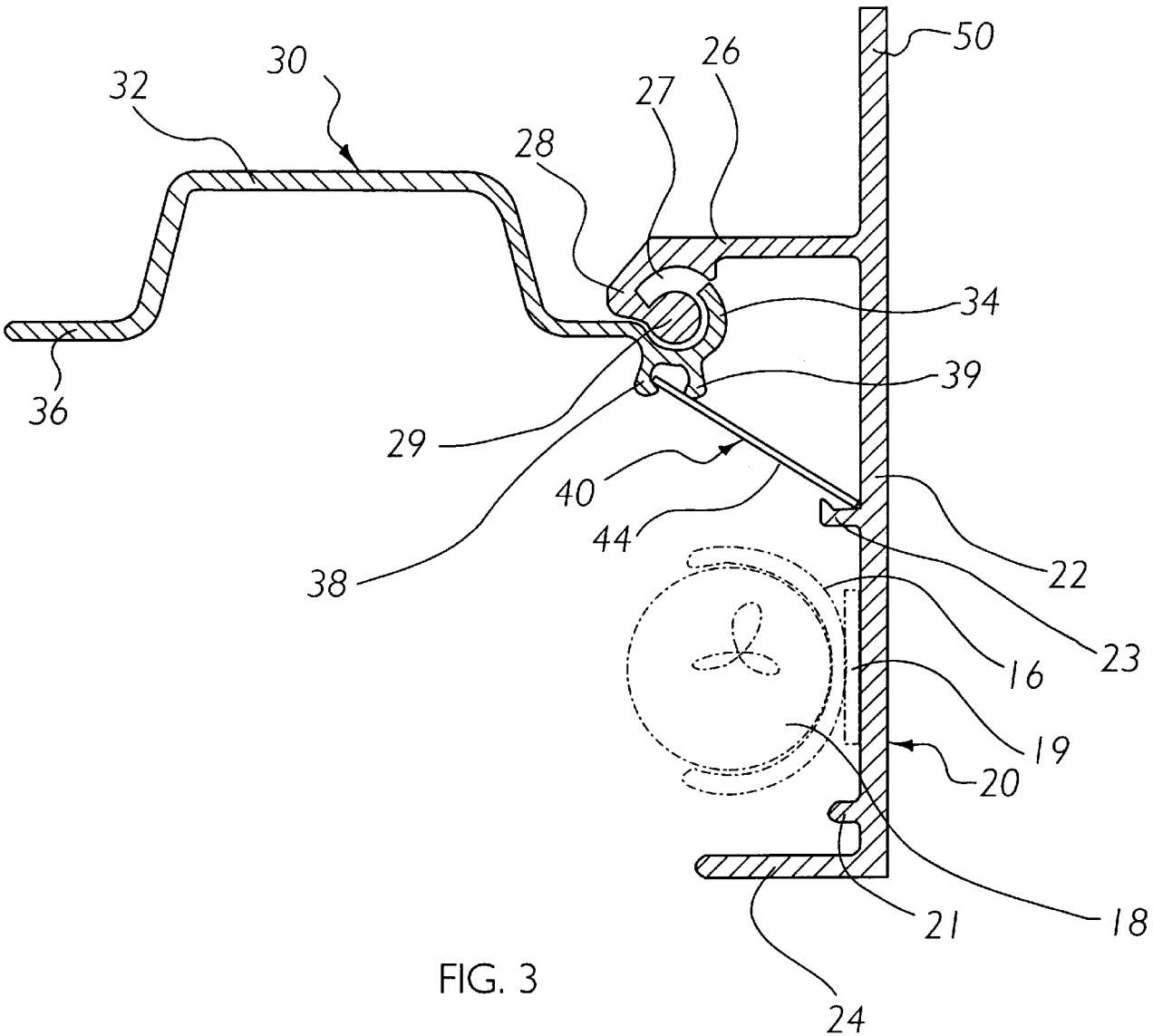
FIG. 3 is a side cut-away view with the cover opened.

As best shown in FIGS. 2 and 3 of the drawings, the elongated base 20 has a U-shaped cross-section. The elongated base 20 comprises a back plate 22, an upper lip 26 and a lower lip 24. The upper lip 26 and the lower lip 24 define a channel which receives at least one tubular light string 18 or other light string. The tubular light string 18 is preferably a product named DURAFLEX made by Horizon Industries. An alignment ridge 21 is within the channel of the elongated base 20 to provide a guide for securing the tubular light string 18 parallel to the lower lip 24.

As best shown in FIGS. 2 and 3 of the drawings, a length of adhesive tape 19 is attached within the channel of the elongated base 20. The adhesive tape 19 has adhesive on both sides for allowing attachment of the retainer 16 as shown in FIGS. 2 and 3. The retainer 16 has a C-shaped cross-section which removably receives the tubular light string 18. The retainer 16 is preferably transparent to allow maximum illumination of the present invention. There are various other systems of retaining the tubular light string 18 or other light strings within the channel of the elongated base 20 which do not need to be discussed.

As shown in FIGS. 2 and 3 of the drawings, the upper lip 26 includes a hinge arm 28. At the end of the hinge arm 28 is a cylindrical member 29 which forms an arcuate channel 27 between the hinge arm 28.

As shown in FIGS. 2 and 3 of the drawings, the cover 30 comprises a face plate 32 having a substantially U-shaped cross-section. The cover 30 includes a hook portion 34 which is in slidable engagement with the arcuate channel 27. The cover 30 further includes a handle portion 36 opposite of the hook portion 34 for allowing manual manipulation of the cover 30 with respect to the elongated base 20.

As shown in FIGS. 1 through 3 of the drawings, the guide member 50 is attached to the corner of the back plate 22 and the upper lip 26. The guide member 50 preferably extends flush from the back plate 22 so as to be juxtaposed to the trim 14 of the building structure when installed. The guide member 50 preferably extends along the length of the elongated base 20, however, a plurality of guide members 50 spaced a finite distance apart can also be utilized. The top of the guide member 50 is higher than the highest point of the cover 30 when fully opened as best shown in FIG. 3 of the drawings, to insure that the cover 30 is fully opened which allows the bias spring 40 to maintain the open position of the cover 30.

As best shown in FIGS. 2 and 3 of the drawings, a first jaw 38 and a second jaw 39 are attached to the hook portion 34 of the cover 30. The second jaw 39 is between the first jaw 38 and the handle portion 36 as best shown in FIGS. 2 and 3 of the drawings. A bracket 23 is attached to the back plate 22 as shown in FIG. 2 of the drawings. The bracket 23 has an L-shaped cross-section which defines a channel between itself and the back plate 22.

Figure 4:
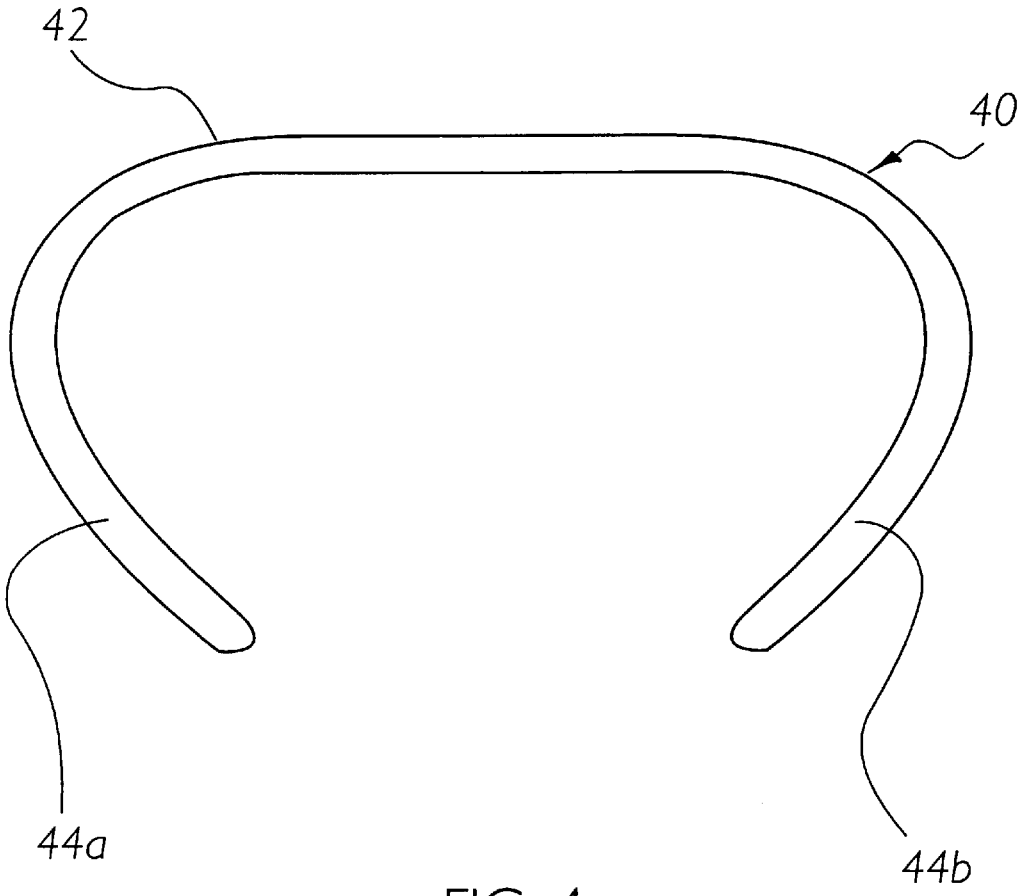
FIG. 4 is a top view of the bias spring.

The bias spring 40 has a base member 42 and a pair of arm members 44*a–b* as best shown in FIG. 4 of the drawings. The base member 42 is preferably longer than the arm members 44*a–b*.

The arm members 44*a–b* are attached at the opposing distal ends of the base member 42 and extend at an acute angle from the base member 42 toward one another. The base member 42 of the bias spring 40 is positioned within the channel created by the first jaw 38 and the second jaw 39. The arm members 44*a–b* extend from the base member 42 to engage the channel created by the bracket 23 and back plate 22.

In use, the user manually positions the light string mounting system 10 along the trim 14 of the building structure. The user positions the top portion of the guide member adjacent to a rain gutter 12 or other physical obstruction. After securing with a conventional fastening system, the user manually manipulates the handle portion 36 of the cover 30 with their hands or an elongated object to open the cover 30. As the cover 30 pivots within the arcuate channel 27, the bias spring 40 is positioned centrally between the first jaw 38 and the second jaw 39. As the cover 30 is pivoted upwardly, the bias spring 40 becomes in engagement with the first jaw 38 thereby assisting in the pivoting of the cover 30 upwardly. After the cover 30 is fully opened, the bias spring 40 retains the cover 30 in the open position for an indefinite length of time. Since the guide member 50 prevents the cover 30 from engaging the rain gutter 12 or other obstruction, the cover 30 is allowed to remain fully open with the bias spring 40 providing the maximum amount of torque upon the cover 2. The user then activates the tubular light string 18 or other light string to illuminate the lights. Since the elongated base 20 is preferably constructed from extruded aluminum, the interior portion of the elongated base 20 has a reflective surface which enhances the light projecting from the tubular light string 18. After the holiday season has passed, the user desires to close the cover 30 to prevent the general public from viewing the unattractive tubular light string 18. The user manually manipulates the cover 30 by engaging the handle portion 36 thereby forcing the cover 30 downwardly until it is in engagement with the lower lip 24 of the elongated base 20. The bias spring 40 is now in engagement with the second jaw 39 thereby forcing the cover 30 to stay in the closed position which prevents movement or accidental opening of the cover 30 during high gusts of wind.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, calling within the scope of the invention.

I claim:

1. A light string mounting system comprising:

an elongated housing having an opening and a channel, wherein said channel receives at least one light string;

a cover pivotally attached to said elongated housing for selectively covering said opening;

at least one guide member attached to said elongated housing which provides sufficient spaced above said elongated housing to allow complete opening of said cover; and at least one bias spring positioned between said cover and said elongated housing for retaining said cover in either a closed position or an open position.

2. The light string mounting system of claim 1, wherein said cover includes a first jaw and a second jaw adjacent a pivot axis, wherein said first jaw and second jaw define a groove which receives said bias spring.

3. The light string mounting system of claim 2, wherein cover is pivotally attached to an upper portion of said elongated housing.

4. The light string mounting system of claim 3, wherein said at least one guide member comprises an elongated member which is substantially a length of said elongated housing.

5. The light string mounting system of claim 4, wherein said bias spring comprises:

a base member which is positioned within said groove; and a pair of arm members extending from opposing ends of said base member which are in engagement with a bracket attached to said elongated housing.

6. The light string mounting system of claim 5, wherein when said cover is in said closed position said bias spring is in engagement with said second jaw, and wherein when said cover is in said open position said bias spring is in engagement with said first jaw for retaining the desired position.

7. The light string mounting system of claim 6, wherein an exterior surface of said cover and said elongated housing includes a color coating which matches a color of trim on a building structure.

8. The light string mounting system of claim 7, wherein said channel of said elongated housing is reflective of light.

9. The light string mounting system of claim 8, wherein said cover includes a handle portion for allowing manual manipulation of the cover.

10. The light string mounting system of claim 9, wherein said elongated housing has a U-shaped cross-section.

11. The light string mounting system of claim 1, wherein said cover includes a handle portion for allowing manual manipulation of said cover; wherein said handle portion extends from said cover opposite of said elongated housing; and wherein said cover has a U-shaped cross-section.

12. The light string mounting system of claim 11, wherein said cover includes a first jaw and a second jaw adjacent a pivot axis, wherein said first jaw and second jaw define a groove which receives said bias spring.

13. The light string mounting system of claim 12, wherein said cover is pivotally attached to an upper portion of said elongated housing.

14. The light string mounting system of claim 13, wherein when said cover is in said closed position said bias spring is in engagement with said second jaw, and wherein when said cover is in said open position said bias spring is in engagement with said first jaw for retaining the desired position.

15. The light string mounting system of claim 14, wherein an exterior surface of said cover and said elongated housing includes a color coating which matches a color of trim on a building structure.

16. The light string mounting system of claim 15, wherein said channel of said elongated housing is reflective of light.

17. The light string mounting system of claim 16, wherein said elongated housing has a U-shaped cross-section.

18. A light string mounting system comprising:

an elongated housing having an opening and a channel, wherein said channel receives at least one light string;

a cover pivotally attached to said elongated housing for selectively covering said opening; and at least one bias spring positioned between said cover and said elongated housing for retaining said cover in either a closed position or an open position.

* * * * *